US011591859B2

(12) United States Patent
Love et al.

(10) Patent No.: US 11,591,859 B2
(45) Date of Patent: Feb. 28, 2023

(54) SURFACE EQUIPMENT PROTECTION FROM BOREHOLE PULSATION ENERGIES

(71) Applicant: Performance Pulsation Control, Inc., Richardson, TX (US)

(72) Inventors: Lucas Love, Spring, TX (US); Gregg Mathiak, Plano, TX (US); John Thomas Rogers, Garland, TX (US); Cersten Jantzon, Kingwood, TX (US)

(73) Assignee: Performance Pulsation Control, Inc., Richardson, TX (US)

( * ) Notice: Subject to any disclaimer, the term of this patent is extended or adjusted under 35 U.S.C. 154(b) by 0 days.

(21) Appl. No.: 17/450,673

(22) Filed: Oct. 12, 2021

(65) Prior Publication Data

US 2022/0112774 A1 Apr. 14, 2022

Related U.S. Application Data

(60) Provisional application No. 63/090,613, filed on Oct. 12, 2020.

(51) Int. Cl.

| | |
|---|---|
| ***E21B 17/042*** | (2006.01) |
| ***E21B 17/07*** | (2006.01) |
| ***E21B 21/01*** | (2006.01) |

(52) U.S. Cl.

CPC ..... *E21B 17/07* (2013.01); *E21B 17/042* (2013.01); *E21B 21/01* (2013.01)

(58) Field of Classification Search

CPC ..... E21B 17/042; E21B 17/07; E21B 21/01

See application file for complete search history.

(56) References Cited

U.S. PATENT DOCUMENTS

| | | | | |
|---|---|---|---|---|
| 2,290,337 A | | 7/1942 | Knauth | |
| 2,757,689 A | | 8/1956 | Knox | |
| 2,773,455 A | | 12/1956 | Mercier | |
| 3,444,897 A | * | 5/1969 | Erickson | G05D 7/012 138/45 |
| 3,587,652 A | * | 6/1971 | Remus | F16L 55/04 138/45 |
| 3,665,965 A | | 5/1972 | Baumann | |

(Continued)

FOREIGN PATENT DOCUMENTS

| | | | | |
|---|---|---|---|---|
| SU | 1686246 A1 | * | 10/1991 | F16F 9/06 |
| SU | 1686246 A1 | | 10/1991 | |

OTHER PUBLICATIONS

International Search Report and Written Opinion of the International Searching Authority dated Jan. 19, 2022, in connection with International Application No. PCT/US2021/054621, 9 pages.

(Continued)

*Primary Examiner* — Matthew R Buck

(57) ABSTRACT

A pulsation and acoustic energy reduction dampener for installation within well piping between a standpipe and a swivel includes a body formed from a union connection sub providing a threaded male connection at one end of the body and welded to a union connection nut providing a threaded female connection at the other end, each for connection to the well piping. A flow restriction orifice assembly is secured by welding or gluing within the union connection sub and includes a replaceable wear component such as an annular ceramic insert with a tapered or cylindrical interior through-hole.

13 Claims, 15 Drawing Sheets

(56) References Cited

U.S. PATENT DOCUMENTS

| | | | | |
|---|---|---|---|---|
| 3,731,709 | A | 5/1973 | Glover | |
| 3,840,051 | A | 10/1974 | Akashi et al. | |
| 3,894,562 | A * | 7/1975 | Moseley, Jr. | F15D 1/02 138/44 |
| 4,269,569 | A | 5/1981 | Hoover | |
| 4,445,829 | A | 5/1984 | Miller | |
| 4,514,151 | A | 4/1985 | Anders et al. | |
| 4,570,745 | A | 2/1986 | Sparks et al. | |
| 4,585,400 | A | 4/1986 | Miller | |
| 4,644,974 | A * | 2/1987 | Zingg | B05B 1/00 138/40 |
| 5,495,872 | A | 3/1996 | Gallagher et al. | |
| 5,868,168 | A | 2/1999 | Mott et al. | |
| 6,741,185 | B2 | 5/2004 | Shi et al. | |
| 6,848,477 | B2 | 2/2005 | Treusch et al. | |
| 7,051,765 | B1 | 5/2006 | Kelley et al. | |
| 7,123,161 | B2 | 10/2006 | Jeffryes et al. | |
| 7,198,102 | B2 | 4/2007 | Virally et al. | |
| 7,345,594 | B2 * | 3/2008 | Huang | G01V 11/002 340/854.3 |
| 8,449,500 | B2 | 5/2013 | DelCastillo et al. | |
| 9,845,795 | B2 | 12/2017 | Manley et al. | |
| 2006/0109141 | A1 | 5/2006 | Huang et al. | |
| 2012/0152360 | A1 | 6/2012 | Marica | |
| 2012/0189477 | A1 | 7/2012 | Rogers | |
| 2013/0037153 | A1 | 2/2013 | Schommer | |
| 2014/0076577 | A1 * | 3/2014 | Shampine | F16L 55/041 166/373 |
| 2014/0118157 | A1 | 5/2014 | Jamison | |
| 2015/0064027 | A1 | 3/2015 | Leugemors et al. | |
| 2015/0096639 | A1 | 4/2015 | Rogers et al. | |
| 2015/0240982 | A1 | 8/2015 | Eisner et al. | |
| 2015/0284811 | A1 | 10/2015 | Knight et al. | |
| 2017/0067456 | A1 | 3/2017 | Manley et al. | |
| 2017/0130706 | A1 * | 5/2017 | Plaza | F04B 47/02 |
| 2017/0159868 | A1 | 6/2017 | Fisher | |
| 2018/0128410 | A1 | 5/2018 | Rogers | |
| 2019/0128462 | A1 * | 5/2019 | Rogers | F16L 55/02718 |
| 2019/0257462 | A1 * | 8/2019 | Rogers | E21B 21/01 |
| 2019/0285220 | A1 | 9/2019 | Eros et al. | |
| 2019/0293058 | A1 | 9/2019 | Manley | |
| 2020/0132237 | A1 | 4/2020 | Rogers | |

OTHER PUBLICATIONS

United States Trademark Registration No. 5,127,212—Charge Free Conversion Kit, 2 pages.

International Search Report and Written Opinion of the International Searching Authority dated Dec. 10, 2018 in connection with International Application No. PCT/US2018/055485, 13 pages.

International Search Report and the Written Opinion of the International Searching Authority, or the Declaration dated Jul. 21, 2020 in connection with International Patent Application No. PCT/US2020/31335, 10 pages.

International Search Report and the Written Opinion of the International Searching Authority, or the Declaration dated Jul. 31, 2020 in connection with International Patent Application No. PCT/US2020/31698, 9 pages.

Office Action dated Sep. 27, 2021 in connection with U.S. Appl. No. 16/157,952, 28 pages.

Office Action dated Oct. 8, 2020 in connection with U.S. Appl. No. 16/157,952, 27 pages.

Final Office Action dated May 7, 2021 in connection with U.S. Appl. No. 16/157,952, 17 pages.

Interview Summary dated Oct. 29, 2021 in connection with U.S. Appl. No. 16/157,952, 3 pages.

Office Action dated Dec. 13, 2021 in connection with U.S. Appl. No. 16/404,248, 9 pages.

Office Action dated Oct. 13, 2020 in connection with U.S. Appl. No. 16/404,248, 24 pages.

Final Office Action dated Apr. 16, 2021 in connection with U.S. Appl. No. 16/404,248, 18 pages.

Office Action dated Sep. 27, 2021 in connection with U.S. Appl. No. 16/730,621, 26 pages.

Interview Summary dated Oct. 29, 2021 in connection with U.S. Appl. No. 16/730,621, 3 pages.

Sigma Drilling Technology, LLC, commercial website, screenshots obtained Nov. 22, 2019; effective date Oct. 1, 2014—see Sigma Drilling Technologies "Terms Conditions" final sentence, 23 pages.

Hon. Amos L. Mazzant, III, Report on the Filing or Determination of an Action Regarding a Patent or Trademark Re: U.S. Appl. No. 14/846,872, filed Sep. 7, 2015, Justin Manley; U.S. Appl. No. 14/846,872, filed Sep. 7, 2015, Justin Manley; U.S. Appl. No. 14/846,872, filed Sep. 7, 2015, Justin Manley and William Garfield, Judgment Entered May 9, 2019; Case 4:17-cv-00450-ALM *Performance Pulsation Control Inc.* v. *Sigma Drilling Technologies, LLC, Justin P. Manley, et al.* United States District Court, Eastern District of Texas, Sherman Division, 1 page.

Office Action dated Jun. 16, 2022, in connection with Algerian Application No. DZ/P/2021/000753, 3 pages.

Examination report dated Apr. 29, 2022, in connection with Indian Application No. 202127055212, 5 pages.

Final Office Action dated May 24, 2022, in connection with U.S. Appl. No. 16/157,952, 28 pages.

Notice of Allowance dated Jun. 9, 2022, in connection with U.S. Appl. No. 16/404,248, 17 pages.

Notice of Allowance dated May 26, 2022, in connection with U.S. Appl. No. 16/730,621, 17 pages.

Office Action dated Sep. 16, 2022 in connection with Eurasian Patent Application No. 202193033, 4 pages.

Office Action dated Aug. 16, 2022 in connection with India Patent Application No. 202127055213, 5 pages.

Office Action dated Oct. 29, 2022 in connection with Saudi Arabia Patent Application No. 521430784, 5 pages.

Non-Final Office Action dated Nov. 30, 2022, in connection with U.S. Appl. No. 16/157,952, 25 pages.

Office Action dated Nov. 9, 2022 in connection with Eurasian Patent Application No. 202193034, 4 pages.

Supplementary European Search Report dated Dec. 13, 2022 in connection with European Patent Application No. 20802519.7, 11 pages.

Supplementary European Search Report dated Dec. 13, 2022 in connection with European Patent Application No. 20802300.2, 10 pages.

Office Action dated Oct. 31, 2022 in connection with Saudi Arabia Patent Application No. 521430785, 11 pages.

* cited by examiner

SURFACE EQUIPMENT PROTECTION FROM BOREHOLE PULSATION ENERGIES

CROSS-REFERENCE TO RELATED APPLICATION AND PRIORITY CLAIM

This application claims priority under 35 U.S.C. § 119(e) to U.S. Provisional Patent Application No. 63/090,613 filed on Oct. 12, 2021, which is hereby incorporated by reference in its entirety.

TECHNICAL FIELD

The present application relates generally to pulsation and acoustic energy reduction dampeners and, more specifically, to pulsation and acoustic energy reduction dampeners installed within piping proximate to the borehole.

BACKGROUND

Pulsation and vibration control in surface equipment with borehole drilling and pumping applications can extend the life of fluid transfer piping components due to reduced cavitation of pumped fluid, improve flow rates by smoothing fluid flow, and facilitate measurement while drilling or measurement while pumping, as well as protecting surface pump systems and other surface equipment such as, but not limited to, standpipes, Kelly hoses, other hoses, top drives and other equipment from damage. U.S. Patent Application Publications Nos. 2019/0128462, 2019/0257462, and 2020/0132237, incorporated herein by reference, propose various improvements to pulsation control in borehole applications, including integration of pulsation and acoustic energy reduction dampeners at non-traditional locations of an overall drilling or production system such as proximate to a top drive, Kelly drive or swivel in a drilling rig. The present disclosure seeks to facilitate such integration.

SUMMARY

This disclosure provides surface equipment protection from borehole pulsation energies A pulsation and acoustic energy reduction dampener is provided for reducing low and high frequency pulsation amplitudes emanating from downhole drilling or production components thereby minimizing system acoustic interactions manifested in large pulsation energies and vibration levels and for reducing vibration, noise and pulsation levels to allow for easier signal detection by the measurements while drilling (MWD) devices and logging while drilling (LWD) devices located on the drilling rig.

In a first embodiment, a pulsation and acoustic energy reduction dampener includes a body and a flow restriction orifice assembly. The body is formed from a union connection sub and a union connection nut. The union connection sub having a threaded male connection at an opposite end from a coupling to the union connection nut and the union connection nut having a threaded female connection at an opposite end from a coupling to the union connection sub. Each of the threaded connections are for connection to piping.

In a second embodiment, a drilling or production system includes at least a standpipe and a pulsation and acoustic energy reduction dampener. The standpipe is positioned between drilling or production components and upstream components. The pulsation and acoustic energy reduction dampener includes a body and a flow restriction orifice assembly. The body is formed from a union connection sub and a union connection nut. The union connection sub having a threaded male connection at an opposite end from a coupling to the union connection nut and the union connection nut having a threaded female connection at an opposite end from a coupling to the union connection sub. Each of the threaded connections are for connection to piping.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 12B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged pump discharge piping or system to control or partially control pulsation & vibration amplitudes.

A pulsation and acoustic energy reduction dampener for installation within surface piping between a standpipe and a swivel includes a body typically formed from a hammer union connection sub providing a threaded male connection (shown with nut) at one end of the body and welded to a union connection nut providing a threaded female connection at the other end, each for connection to the well piping. A flow restriction orifice assembly is secured by press fitting, welding, gluing, or epoxying, or otherwise affixing within the union connection sub and may include a replaceable wear component such as an annular ceramic or tungsten carbide insert with a tapered or cylindrical interior throughhole. Alternative pulsation and acoustic energy reduction dampener designs are typically one-piece designs with non-replaceable internal features.

The pulsation and acoustic energy reduction dampeners (all variants shown) reduce both low and high frequency pulsation amplitudes emanating from both the mud pumps and downhole agitator shock tool (bi-directional) thereby minimizing system acoustic interactions manifested in large pulsation energies and vibration levels. It is important to minimize the shaking forces (vibrations) promoting fixtures and structures falling from the drilling mast and potentially injuring rig personnel on the drill floor. It also protects and allows the wash pipe and packing, as well as other rig components, to last longer. In addition, the pulsation and acoustic energy reduction dampeners (all variants described) reduces vibration, noise, and pulsation levels to allow for easier signal detection by the measurements while drilling (MWD) and logging while drilling (LWD) devices located on the drilling rig.

Figure 1:
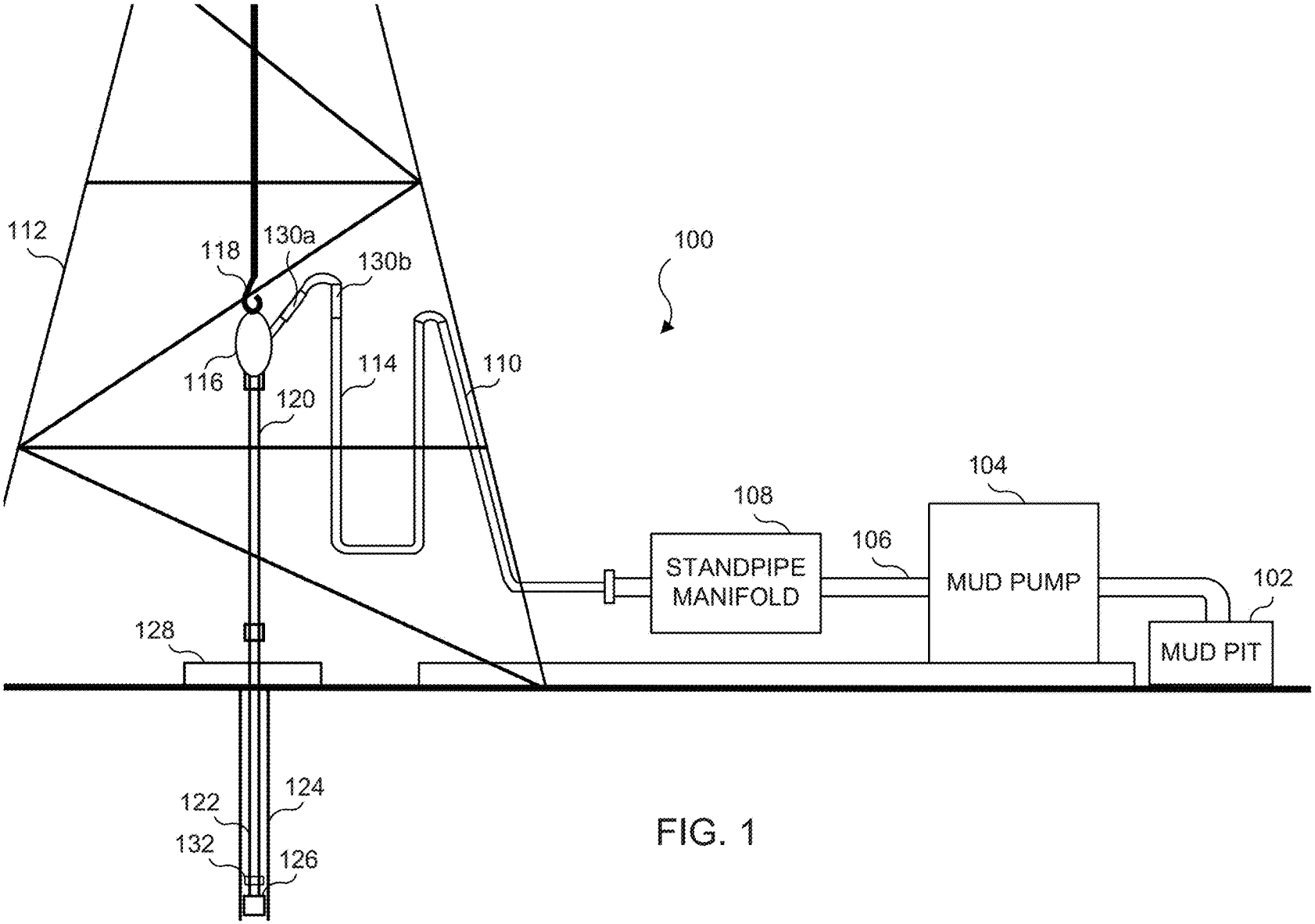
FIG. 1 illustrates a diagrammatic view of a drilling or production system 100 including a flow restriction pulsation and acoustic energy reduction dampener integrated into hosing or piping connectors according to embodiments of the present disclosure.

FIG. 1 illustrates a diagrammatic view of a drilling or production system 100 including a flow restriction pulsation and acoustic energy reduction dampener integrated into hosing or piping connectors according to any of the various embodiments that are described in further detail below. The embodiment of the drilling system 100 illustrated in FIG. 1 is for illustration only. FIG. 1 does not limit the scope of this disclosure to any particular implementation of a drilling or production system.

Referring now to FIG. 1, the drilling or production system 100 includes at least one pulsation and acoustic energy reduction dampener 130*a* and/or 130*b* and a fluid pump or mud pump 104 coupled to a discharge line 106. The drilling or production system 100 may optionally include a standpipe manifold 108 and a standpipe 110 (which is attached to and/or coupled in fluid communication with the rig 112) connected between the discharge line 106 and the borehole 124. The drilling or production system 100 may also include a mud pit 102 connected to an inlet of the pump 104 such that, when the drilling or production system 100 is configured as a drilling system, the pump 104 operates to pump mud or other fluids down a well currently being drilled to keep a drill bit 126 from overheating, provide lubrication to the drill bit 126, and remove rock cuttings to the surface. The mud pump 104 may pump fluid or mud from the mud pit 102 through the discharge line 106 in the direction of a drilling rig 112. More than one mud pump 104 can be utilized in a drilling system 100 to continue drilling upon the failure of a single mud pump 104. The mud pit 102 can also reference a fluid reservoir or tank, where the fluid reservoir stores a fluid used during a drilling process.

When the drilling or production system 100 is configured as a pumping system, the pump 104 operates to pump fluids out of the borehole 124 into a reservoir (not shown). Those skilled in the art understand that, in such embodiments, the discharge line 106 is actually an inlet line, and the outlet of the pump 104 is coupled to the reservoir rather than the mud pit 102. For simplicity and clarity, the present disclosure with utilize the drilling system embodiments as exemplary. Those skilled in the art will recognize that the principles described below may be readily adapted to production system embodiments.

Conventionally, a pulsation dampener is located along the discharge line 106 at the outlet of the pump 104 and before the standpipe manifold 108 (or between the outlet of the pump 104 and the reservoir). The standpipe 110 may be installed on the drilling rig 112 and travel up a mast of the drilling rig 112 to provide the fluid stream through a rotary hose 114 connected to a swivel 116, the swivel 116 coupled to a rotary hook 118. The standpipe 110 receives discharge from the standpipe manifold 108.

The swivel 116 may serve as a passageway for the fluid stream into a Kelly drive 120 (or just "Kelly"). The Kelly 120 connects to a drill string 122. The fluid passes through the Kelly 120 and the drill string 122 down a borehole 124 to a drill bit 126 disposed at a far end of the drill string 122. The Kelly 120 is typically rotated by a rotary table 128. More recent systems may include a top drive to rotate the drill string 122 as an alternative to the rotary table and Kelly drive, and the present disclosure is applicable to such top drive configurations as well.

As disclosed in the above-identified patent application publications, in drilling systems, pulsation and acoustic energy reduction dampeners 130*a* and/or 130*b* can be installed near the swivel 116, Kelly 120, and other components that serve as a conduit for fluid through the swivel 116. Instruments used for monitoring and measuring operations while drilling can also be affected by the residual pulsations from the mud pump 104. Even the smallest pulsations and system interactions can affect the measurement readings.

The device is also to reduce interactions with pulsations & acoustic energy emitted from the downhole agitator shock tool 132. Typically, a shock tool is run with the agitator where the agitator is used to enhance mud flow to the bit through mechanical drill string vibrations or pulsation. Use of the agitator and agitator with shock tool allows for mechanically induced pulsation to travel up the drill string. These pulsations interact with the mud pump pulsations causing potentially large pressure disturbances at the surface (in the mast), which are unwanted vibrations. Our device helps mitigate this from occurring.

The pulsation and acoustic energy reduction dampener 130*a* and/or 130*b* reduces both low and high frequency pulsation magnitudes to allow the wash pipe and packing, as well as other components, to last longer. In addition, the pulsation and acoustic energy reduction dampener 130*a* and/or 130*b* reduce vibration, noise, and pulsation levels to allow for easier signal detection by the measurements while drilling (MWD) and logging while drilling (LWD) devices located on the drilling rig 112. The pulsation and acoustic energy reduction dampener 130*a* and/or 130*b* also assists with reducing interference with downhole instruments that may pick up the residual pulsations and that skew detections and generated data from the downhole instruments.

Figure 2:
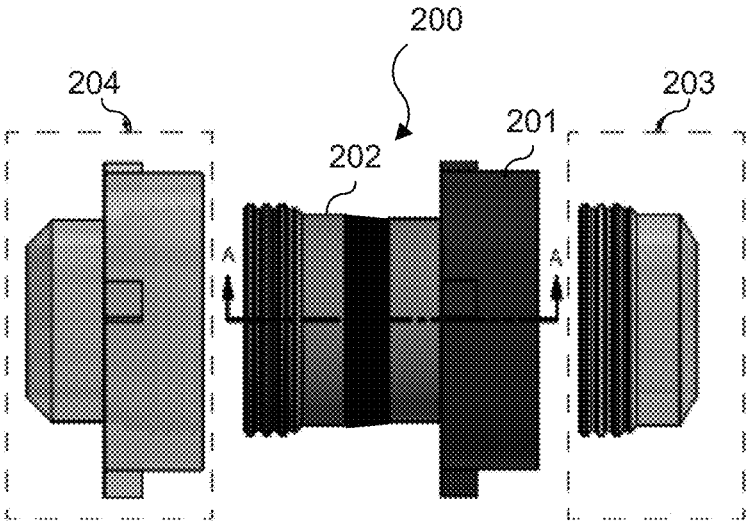
FIGS. 2, 2A and 2B depict the structure of a pulsation and acoustic energy reduction dampener in accordance with embodiments of the present disclosure.
Figure 2A:
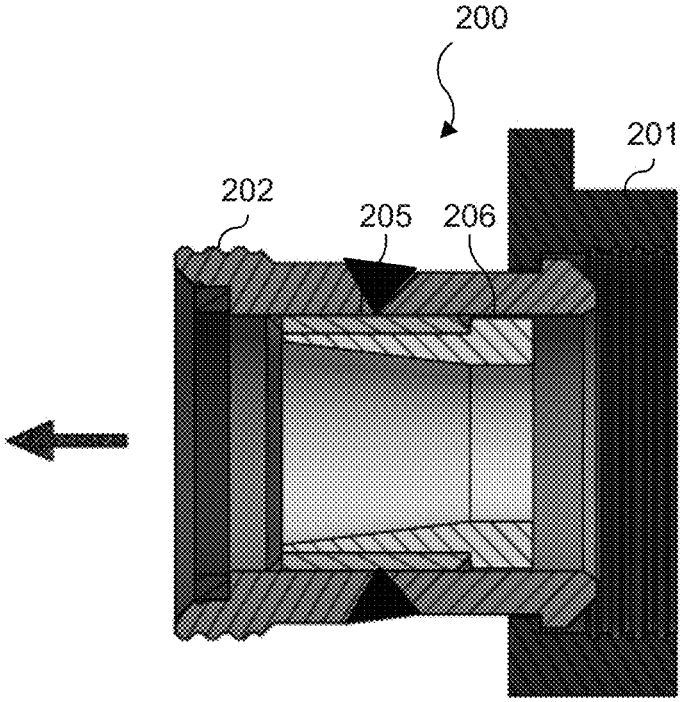
Figure 2B:
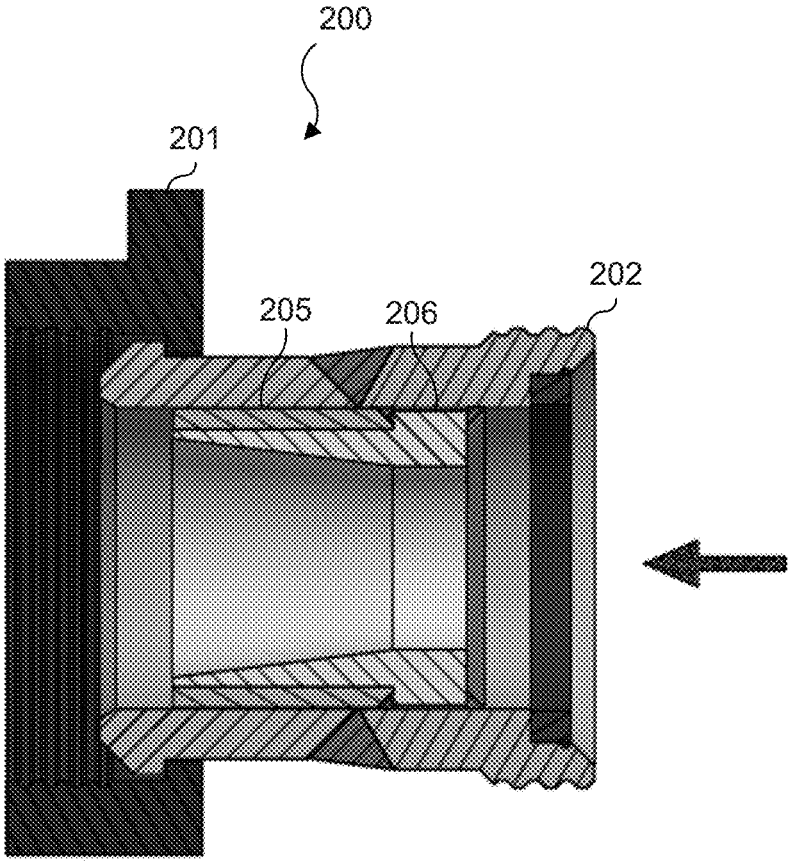

FIGS. 2, 2A and 2B depict the structure of a pulsation and acoustic energy reduction dampener 200 in accordance with embodiments of the present disclosure. FIG. 2 is a side view, while FIG. 2A is a side sectional view of a portion of FIG. 2 taken at section line A-A in FIG. 2; and FIG. 2B is a side section view of a portion of FIG. 2 taken at section line A-A in FIG. 2 with the resistant orifice insert 206 inserted the opposite direction of FIG. 2A. FIGS. 2, 2A, and 2B are merely exemplary, for purposes of explaining the principles of the present disclosure, and are not intended to be limiting. Pulsation and acoustic energy reduction dampener 200 is preferably positioned around the location of pulsation and acoustic energy reduction dampener 130*a* in FIG. 1, although the same structure may be employed for pulsation and acoustic energy reduction dampener 130*b* or for pulsation and acoustic energy reduction dampeners at other locations in the flow path including at locations at either end of the standpipe 110 and anywhere between standpipe 110 and swivel 116.

Figure 4:
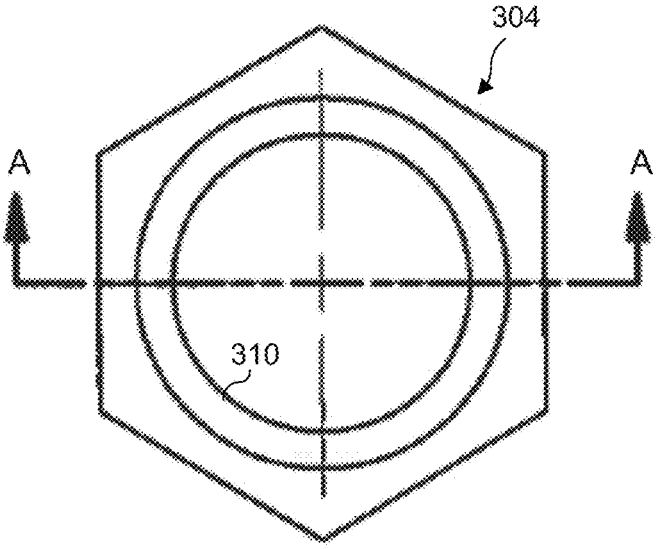
FIGS. 4 and 4A illustrate a hex nut within the pulsation and acoustic energy reduction dampener of FIGS. 3, 3A and 3B.

The pulsation and acoustic energy reduction dampener 200 is formed using a set of male (nut)/female hammer union subs, such as 4" Fig 602 or 4" Fig 1502 connections, making installation very easy using existing mud line connections within the derrick or other high-pressure piping locations. In the embodiment depicted in FIGS. 2 and 2A, a nut 201 is coupled to a female sub 202, with the two components welded together. As indicated by the large arrow in FIG. 2A, the direction of pumped fluid flow is from the male sub with nut 201 to the female sub 202. FIG. 2B shows the direction of pumped fluid flow is from the female sub 202 to the male sub with nut 201. The male sub with nut 201, receives a female mud line or piping sub connector 203, while the female sub 202 is received by a male mud line or piping connector 204. As indicated by the dashed lines, connectors 203 and 204 are not part of the pulsation and acoustic energy reduction dampener 200. Inside the pulsation and acoustic energy reduction dampener, flow restriction is provided by (in the example shown) an orifice assembly including an annular collar 205 and an insert/orifice 206. The orifice assembly is installed into the annular collar interior of the pulsation and acoustic energy reduction dampener. The body of the pulsation and acoustic energy reduction dampener has a female ID threaded coupling (e.g., welded therein, press fit therein or machined into the inner diameter. Inside the annular collar 205 is inserted an orifice of any material including a high wear resistant material retained in place by glue, epoxy or press fit. As shown, the orifice insert 206 abuts a shoulder of the annular collar 205 to keep the wear orifice insert 206 from being pushed out by fluid flow. The wear part is replaceable. The orifice insert 206 thus includes a portion that is received by the annular collar 205 and that is tapered internally and can be positioned with the bevel directed towards the flow as seen in FIG. 2B or shouldered towards the inlet flow as seen in FIG. 2A, creating a pressure drop attenuating fluid pressure pulses and downhole agitator pulsation acoustic energies. Of course, the orifice assembly may be oriented in the opposite direction within the body of the pulsation and acoustic energy reduction dampener 200. as seen in FIG. 2A and FIG. 2B. The portion of the insert 206 that is not received by the annular collar 205 abuts the sleeve, and the orifice insert 206 is preferably made of a wear-resistant material. When mounted in place within the mud line or piping, the end of female connector 203 may abut one end of the male sub 201, while the end of male connector 204 may abut one end of the female sub 202.

The taper of orifice insert 205 within pulsation and acoustic energy reduction dampener 200 may be optimized for specific drilling mud pump conditions, including mud pump model, stroke length, liner sizes, pump speed (flow ranges) and average mud weights used. As a result of the flow restriction, pulsation and acoustic energy reduction dampener 200 protects surface equipment from pulsation energies and vibrations generated by the interaction of the bottom hole assembly of the drill string and surface mud pump 104. The bottom hole assembly may contain agitators and shock tools generating fluid pressure pulses. Preferably installed above the top drive and upper drill stem Kelly valve, pulsation and acoustic energy reduction dampener 200 reduces pressure disturbances generated by the interaction of the bottom hole assembly and surface mud pumps that would otherwise travel beyond the surface and could set up potentially harmful harmonic disturbances impacting surface mud line equipment such as wash pipe packing, Kelly hoses, mud pumps and traditional pulsation and acoustic energy reduction dampener mounted at the outlets of mud pumps. Pulsation energies and system interaction generates large mechanical shaking forces (vibrations) within the drilling mast 112 presenting a fall hazard of mast lighting fixtures, piping clamps, etc. offering a significant safety risk to drilling floor personnel.

Figure 3A:
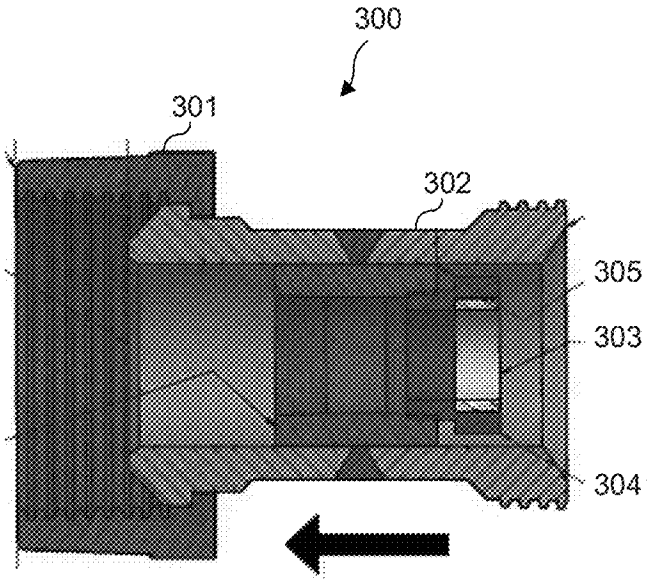
FIGS. 3, 3A and 3B depict the structure of a pulsation and acoustic energy reduction dampener in accordance with alternative embodiments of the present disclosure.
Figure 3B:
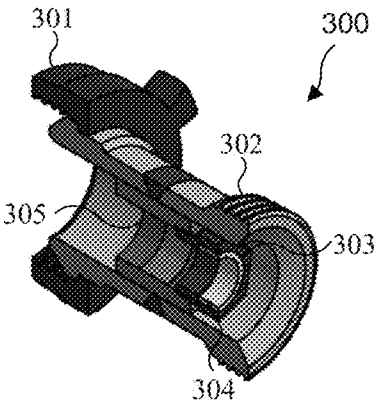
Figure 3:
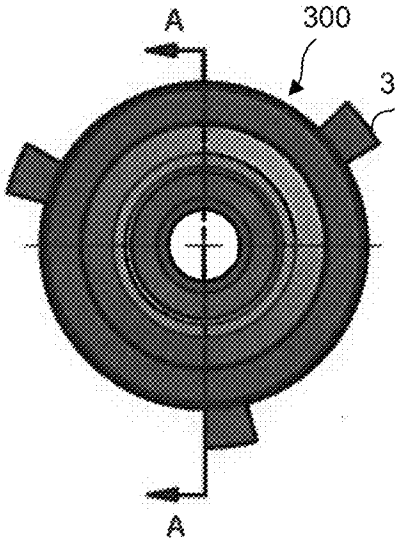

FIGS. 3, 3A and 3B depict the structure of a pulsation and acoustic energy reduction dampener in accordance with alternative embodiments of the present disclosure. FIG. 3 is an end view, while FIG. 3A is a side sectional view of FIG. 3 taken at section line A-A in FIG. 3 and FIG. 3B is a perspective view of FIG. 3 taken at section line A-A in FIG. 3. FIGS. 3, 3A and 3B are merely exemplary, for purposes of explaining the principles of the present disclosure, and are not intended to be limiting. pulsation and acoustic energy reduction dampener 300 may be mounted in the same manner as pulsation and acoustic energy reduction dampener 200 in FIGS. 2 and 2A, and provides similar benefits to those described above.

The pulsation and acoustic energy reduction dampener 300 includes a winged annular male sub with nut 301 and an annular female sub 302 ((e.g., both 5" Fig 1502 Schedule XXH with other sizes available as well), which may be welded together. As indicated by the large arrow, the direction of pumped fluid flow is once again from the sub 302 to the nut 301. One end of the sub 302 is received by the nut 301, with the other end of the sub 302 including external threads configured to be received by a female connector and the distal end of the nut 301 including internal threads for receiving a male connector.

Flow restriction inside pulsation and acoustic energy reduction dampener 300 is provided by an orifice assembly including an annular ceramic tungsten carbide, or any other material insert 303 that is received in a portion of a hex nut 304, which is partially received by and abuts a coupler 305. The coupler 305 may be welded into the interior of the sub 302, or alternatively may be machined into the inner diameter during machine fabrication of the sub 302. The hex nut 304 may be threaded, glued, epoxied, or welded into the coupler 305, and the ceramic or tungsten carbide insert 303 (a high wear resistant orifice) may be glued, epoxied or press-fit or otherwise inserted into the hex nut 304. Each of hex nut 304 and insert 303 abuts a shoulder in the receiving structure to keep from being pushed out by fluid flow. This orifice assembly design produces a stronger part and a more reliable orifice feature. As with the orifice assembly for FIGS. 2 and 2A, the orifice assembly depicted in FIGS. 3, 3A and 3B may be oriented in the opposite direction within the body of the sub 302 for fluid flow in the opposite direction through the pulsation and acoustic energy reduction dampener 300. The orifice feature may be oriented facing downhole and away from the flow.

Figure 5A:
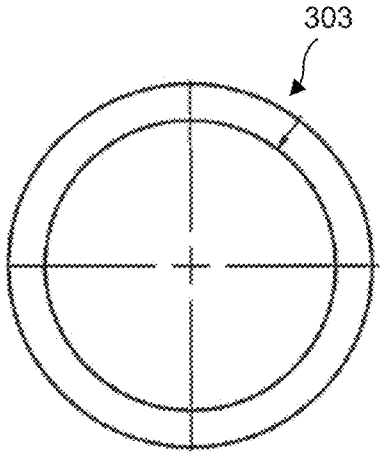
FIGS. 5A and 5B illustrate an insert within the pulsation and acoustic energy reduction dampener of FIGS. 3, 3A and 3B.
Figure 4A:
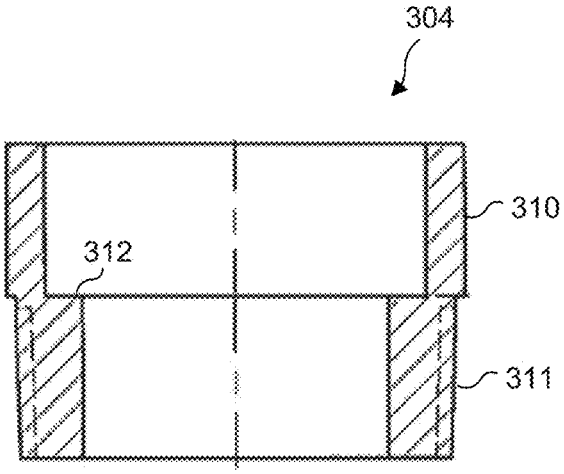
Figure 5B:
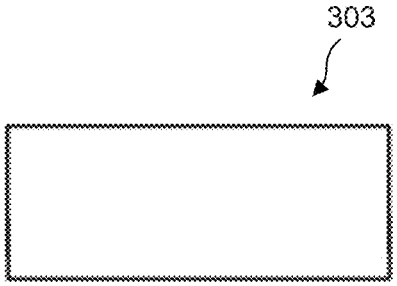
Figure 6:
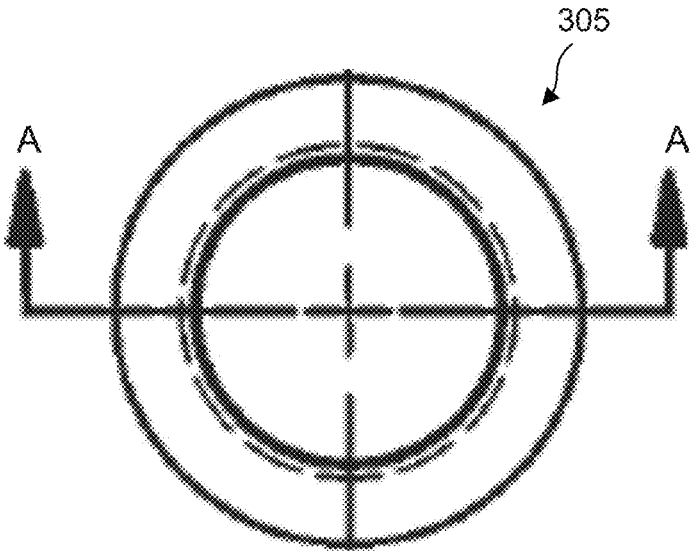
FIGS. 6 and 6A illustrate a coupler within the pulsation and acoustic energy reduction dampener of FIGS. 3, 3A, and 3B.
Figure 6A:
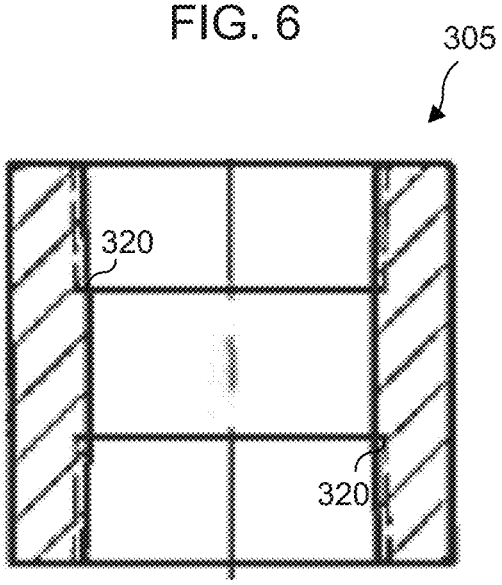

FIGS. 4, 4A, 5A, 5B, 6, and 6A more fully depict structure of the orifice assembly components in FIGS. 3, 3A and 3B. FIGS. 4 and 4A illustrate the hex nut 304; FIGS. 5A and 5B illustrate the ceramic, tungsten carbide, or any other material insert 303; and FIGS. 6 and 6A illustrate the coupler 305. FIG. 4 is a plan view while FIG. 4A is a side sectional view taken at line A-A in FIG. 4. Hex 304 is generally annular with a hexagonal portion 310 and a tapered cylindrical (round) portion 311. The cylindrical opening through the hexagonal portion 310 is larger than the cylindrical opening through the tapered round portion 311, forming a ledge 312 against which the ceramic insert 303 abuts when the ceramic insert 303 is inserted into the opening through the hexagonal portion 310. FIG. 5A is a plan view and FIG. 5B is a side view of the ceramic insert 303, which is a simple annular cylinder sized to fit within and be completely received by the opening through the hexagonal portion 310 of the hex nut 304. Insert 303 provides wear resistance, and may have (for example) an inner diameter of between 2.00 and 2.25 inches and an outer diameter of between 2.25 and 2.50 inches. FIG. 6 is a plan view of coupler 305, and FIG. 6A is a side sectional view take at line A-A in FIG. 6. Coupler 305 is cylindrical, with the axial annulus being larger at the ends than in the middle to receive the cylindrical portion of hex nut 304 and form ledges 320 against which the end of that cylindrical portion abuts.

Figure 7:
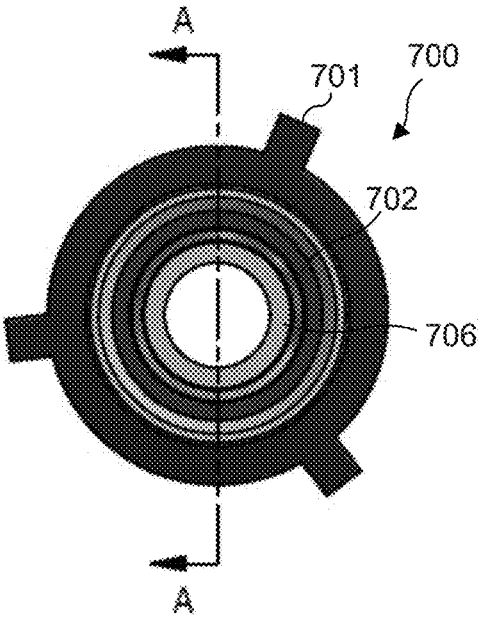
FIGS. 7, 7A, 7B, 7C, 7D, and 7E depict the structure and installation of a pulsation and acoustic energy reduction dampener in accordance with still other embodiments of the present disclosure.
Figure 7A:
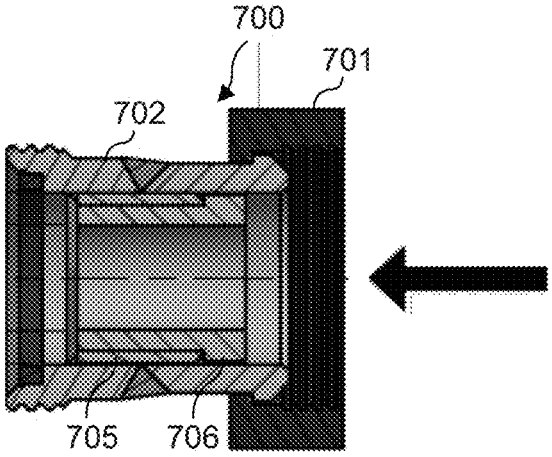
Figure 7B:
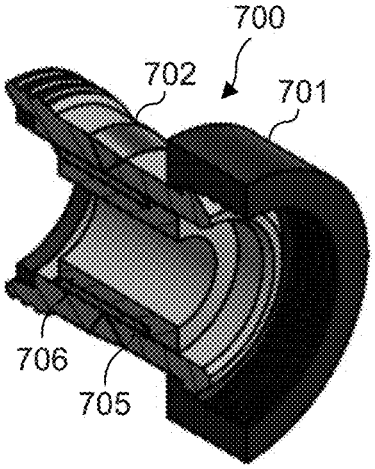
Figure 7C:
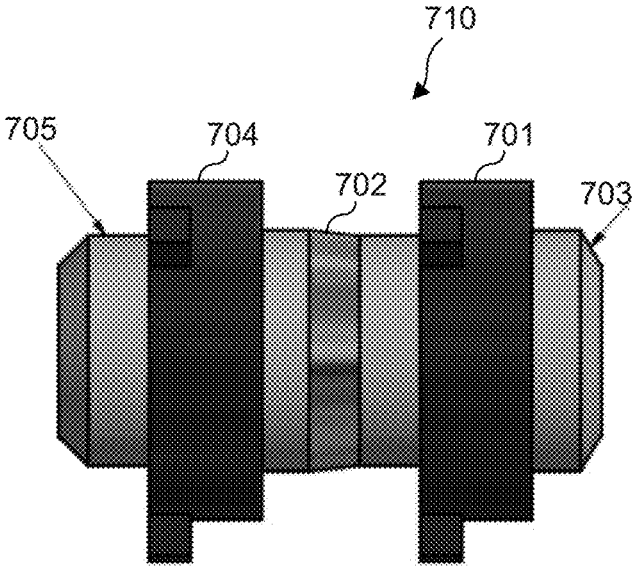
Figure 7D:
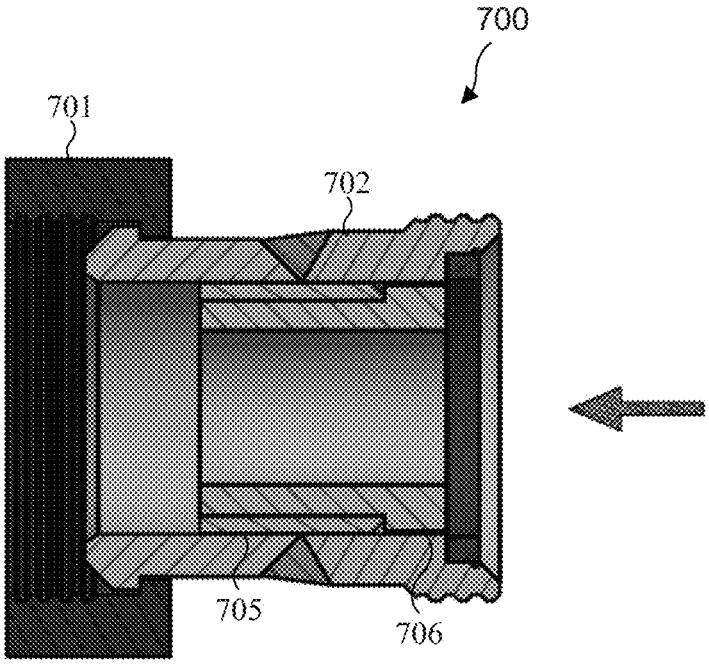
Figure 7E:
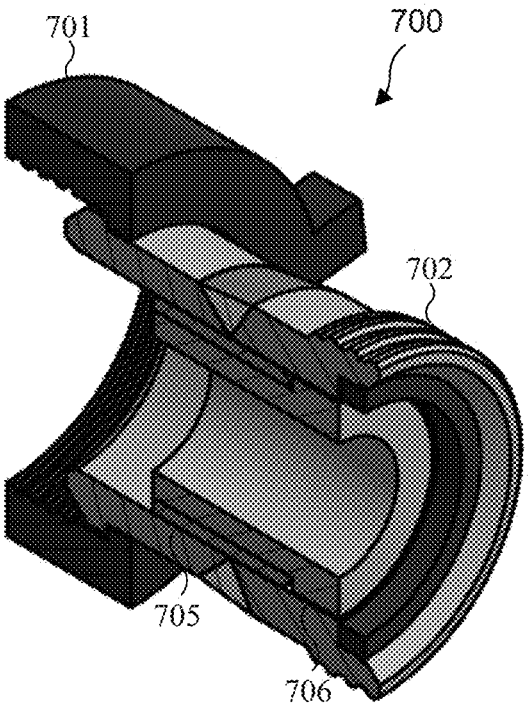

FIGS. 7 and 7A-7E depict the structure and installation of a pulsation and acoustic energy reduction dampener in accordance with still other embodiments of the present disclosure. FIG. 7 is an end view; while FIG. 7A is a side sectional view of FIG. 7 taken at section line A-A in FIG. 7; FIG. 7B is a perspective sectional view; FIG. 7C is a side view of an assembly including the pulsation and acoustic energy reduction dampener of FIGS. 7 and 7A-7B; FIG. 7D is a side section view of FIG. 7 taken at section line A-A in FIG. 7 with a square end of the insert facing downhole; and FIG. 7E is a perspective sectional view of FIG. 7D. FIGS. 7 and 7A-7E are merely exemplary, for purposes of explaining the principles of the present disclosure, and are not intended to be limiting. pulsation and acoustic energy reduction dampener 700 may be mounted in the same manner as pulsation and acoustic energy reduction dampener 200 in FIGS. 2 and 2A, and provides similar benefits to those described above.

Pulsation and acoustic energy reduction dampener 700 includes a winged annular nut 701 and an annular sub 702 ((e.g., both 4" Fig 602), which may be welded together. As indicated by the large arrow, in this embodiment the direction of pumped fluid flow is nominally from the nut 701 to the sub 702. The direction of flow can be reversed flowing from female sub 702 to male sub nut 701 when the internal replaceable orifice insert is positioned in the opposite direction. One end of the sub 702 is received by the nut 701, with the other end of the sub 702 including external threads configured to be received by a female connector and the distal end of the nut 702 including internal threads for receiving a male connector.

Inside the pulsation and acoustic energy reduction dampener sub 702, flow restriction is provided by (in the example shown) an orifice assembly including an annular collar 705 welded into the pulsation and acoustic energy reduction dampener sub 702 or screwed into internal threads therein. The annular collar 705 receives a replaceable orifice insert 706 providing a wear orifice therethrough, glued, epoxied or press-fit in place. The replaceable insert 706 includes a portion that is received by the annular collar 705, but (in contrast with the embodiment of FIGS. 2 and 2A) has a simply cylindrical annulus therethrough. The replaceable insert 706, however, provides flow restriction by narrowing the flow path relative to upstream inner pipe diameter(s). As with the above-described embodiments, the orientation of the orifice assembly may be reversed to accommodate a change in flow direction, which is shown in FIGS. 7D and 7E.

When mounted in place within the mud line or piping, the pulsation and acoustic energy reduction dampener 700 forms an assembly 710 in which the winged nut 701 connects to upstream piping 703 and which includes a winged nut 704 securing downstream piping to the pulsation and acoustic energy reduction dampener. Within the assembly 710, the end of upstream piping female sub 703 is in proximity to one end of the insert 706, while the end of downstream piping 705 abuts the distal end of the annular collar 705.

Figure 8A:
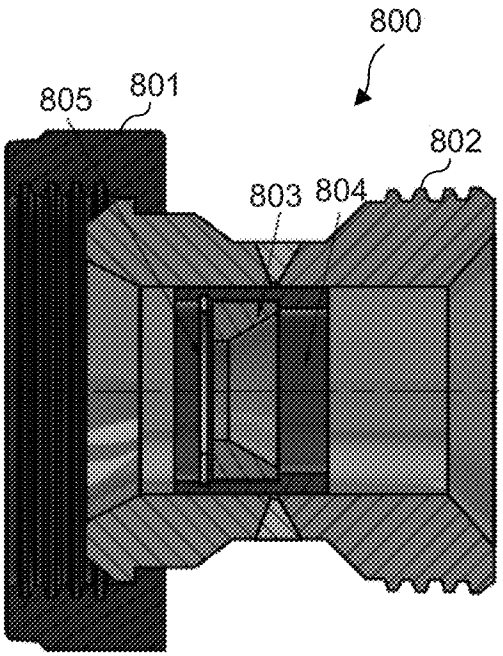
FIGS. 8, 8A, 8B, 9, 9A, 9B, 10, and 10A illustrate the structure of a pulsation and acoustic energy reduction dampener with a reversible flow restriction structure having an easily replaceable wear insert in accordance with embodiments of the present disclosure.
Figure 8:
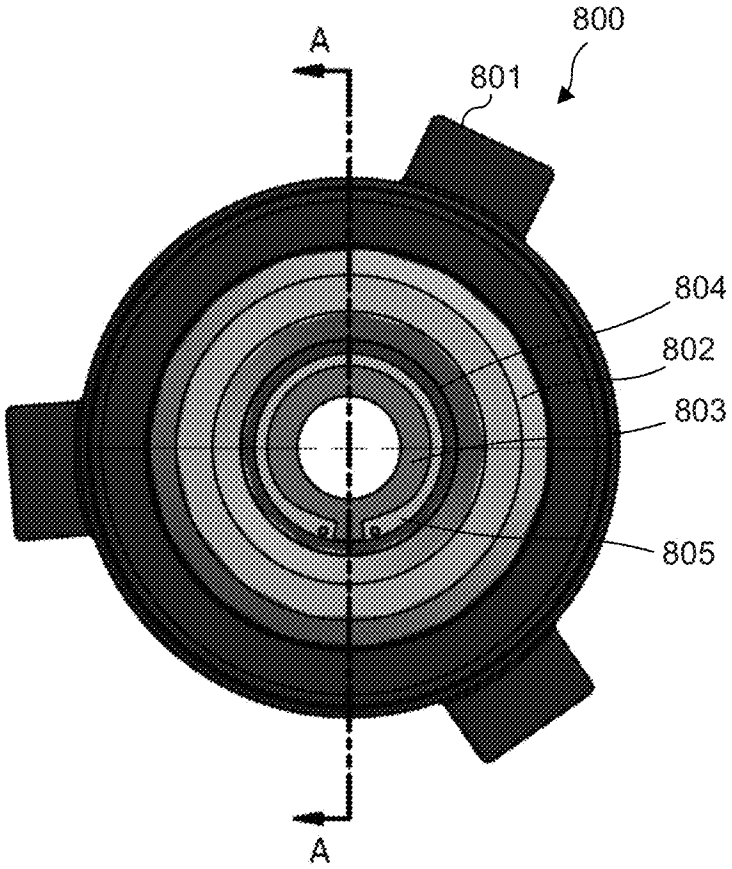
Figure 8B:
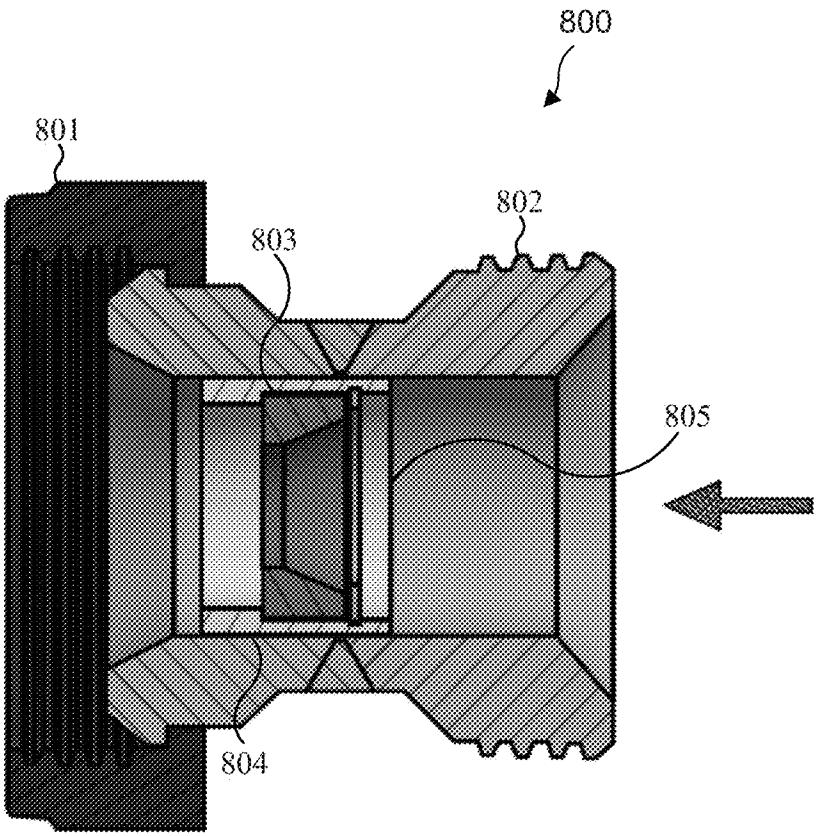
Figure 9A:
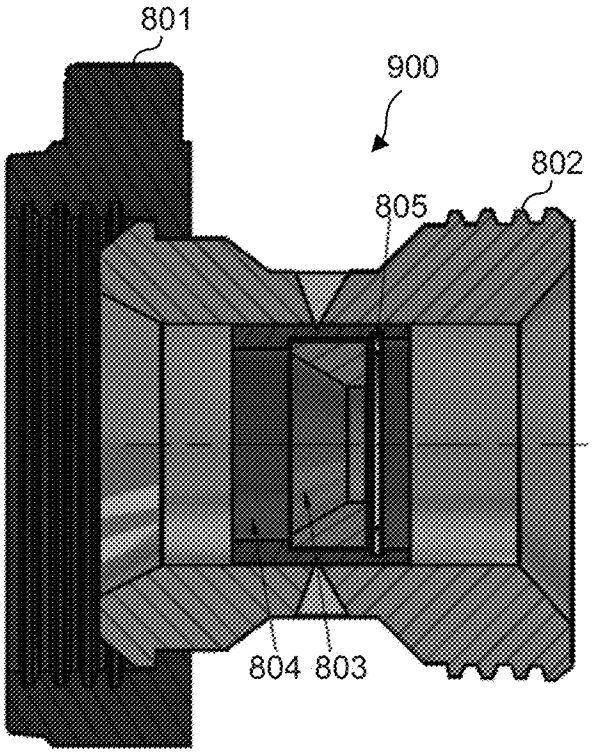
Figure 9:
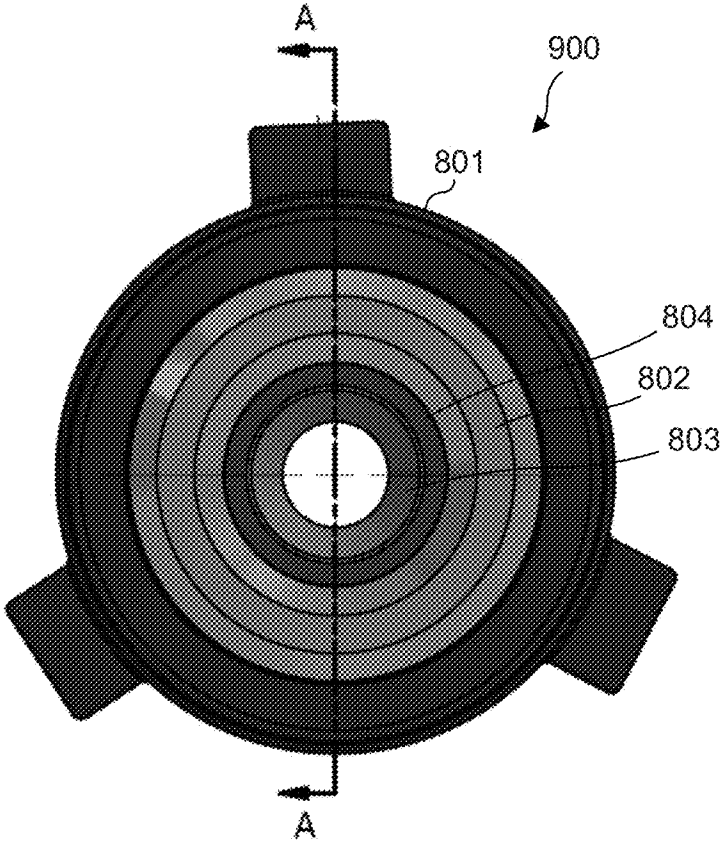
Figure 9B:
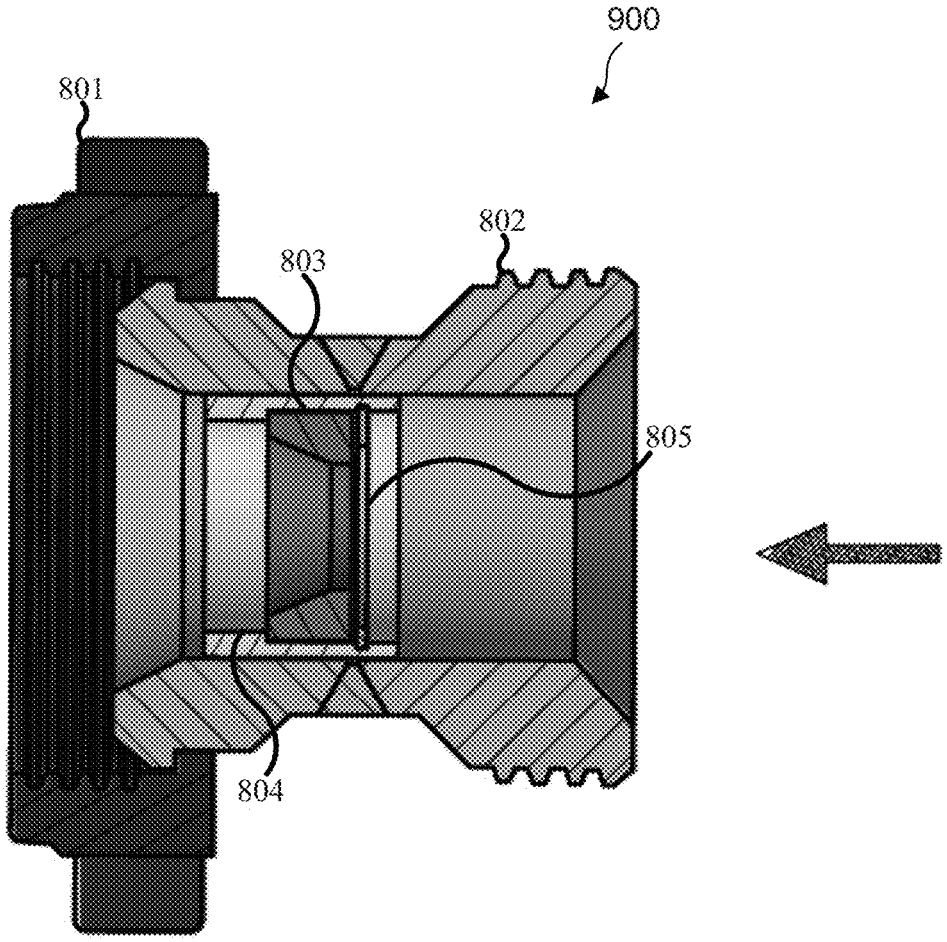
Figure 10:
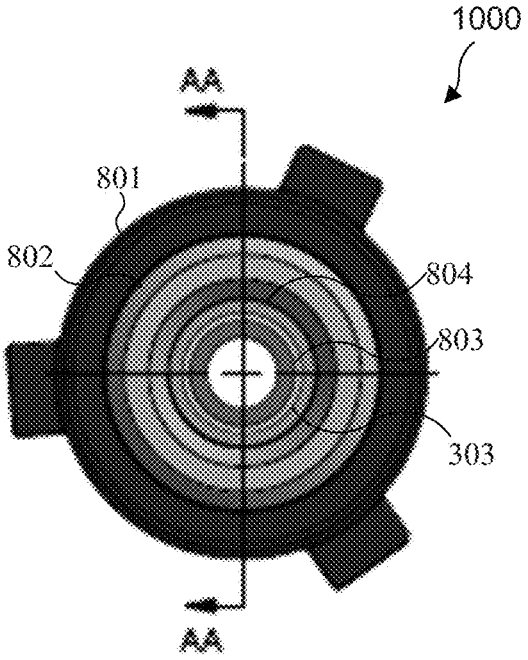
Figure 10A:
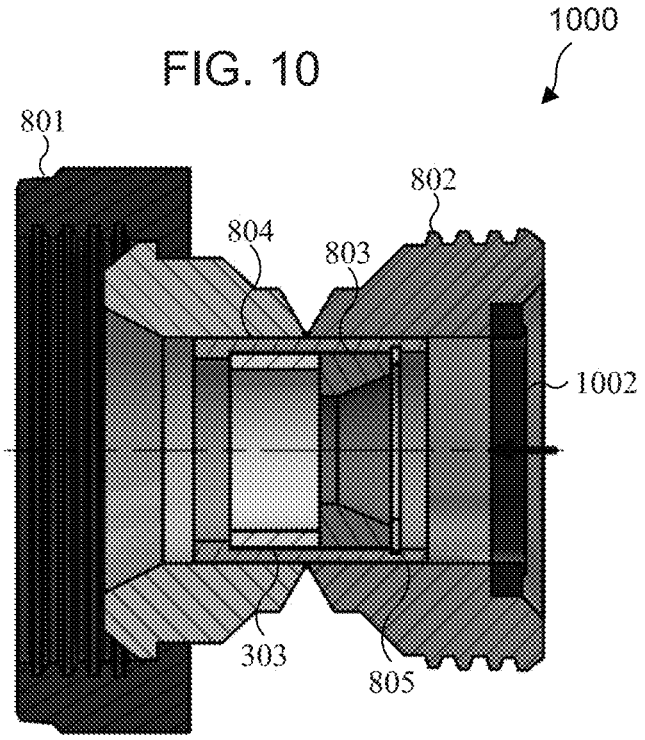

FIGS. 8, 8A, 8B, 9, 9A, 9B, 10, and 10A illustrate the structure of a pulsation and acoustic energy reduction dampener with a replaceable and reversible flow restriction or orifice structure, with FIGS. 10 and 10A showing an easily replaceable wear tail ring 1002 located downstream of the flow restriction or orifice. The tail ring 1002 is designed to account for turbulent flow downstream of the orifice in accordance with embodiments of the present disclosure. FIG. 8 is an end view, while FIG. 8A and FIG. 8B are each a side sectional view of FIG. 8 taken at section line A-A in FIG. 8. Similarly, FIG. 9 is an end view, while FIGS. 9A and 9B are side sectional views of FIG. 9 taken at section line A-A in FIG. 9. FIG. 10 is an end view and FIG. 10A is a side sectional view taken at section line A-A in FIG. 10. FIGS. 8, 8A, 8B, 9, 9A, 9B, 10, and 10A are merely exemplary, for purposes of explaining the principles of the present disclosure, and are not intended to be limiting. Pulsation and acoustic energy reduction dampeners 800, 900, 1000 may be mounted in the same manner as pulsation and acoustic energy reduction dampener 200 in FIGS. 2 and 2A, and provides similar benefits to those described above.

The pulsation and acoustic energy reduction dampener 800, 900 each includes a winged annular nut 801 and an annular sub 802 ((e.g., both 4" Fig 1002 Schedule XXH), which may be welded together. One end of the sub 802 is received by the nut 801, with the other end of the sub 802 including external threads configured to be received by a female connector. and the distal end of the nut 801 including internal threads for receiving a male connector.

Flow restriction in pulsation and acoustic energy reduction dampener is provided by a reversible orifice 803. The orifice assembly structure includes the orifice 803, retainer sleeve 804, and retaining snap ring 805. Retainer sleeve 804 is glued, epoxied, welded, press-fit or screwed into place within the interior of the pulsation and acoustic energy reduction dampener. Orifice plate 803 is cylindrical with an axial through-hole that has a tapered portion, wider at one end of the orifice plate 803, leading into a cylindrical opening at the other end of the orifice plate 803. Orifice plate 803 is received within an axial cylindrical annulus through the retainer sleeve 804, with the annulus being smaller than the orifice plate 803 at one end to form a shoulder against which the orifice plate 803 abuts. The retaining ring 805 is a non-compressible, incomplete annular disk that is also received within the annulus through retainer sleeve 804 and expands into an interior groove in the retainer sleeve 804 to hold the orifice plate 803 or combination of the orifice plate 803 and tail ring 1002 against the shoulder formed by the narrow portion of the annulus. This structure simplifies replacement of the orifice plate 803 and tail ring (FIG. 10) when necessitated by wear, or when an orifice plate with a different taper is needed due to different flow characteristics.

Figure 11A:
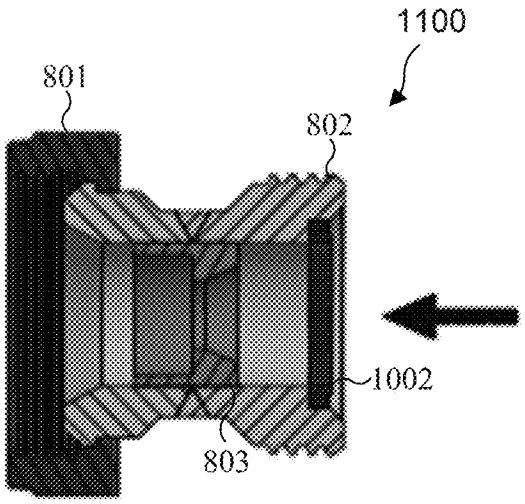
FIGS. 11, 11A and 11B illustrate the structure of a pulsation and acoustic energy reduction dampeners with a non-reversible orifice flow restriction except by acquiring the suitable pulsation and acoustic energy reduction dampener orifice with downstream tail assembly having a permanent tungsten carbide coated wear internal anulus in accordance with embodiments of the present disclosure.
Figure 11B:
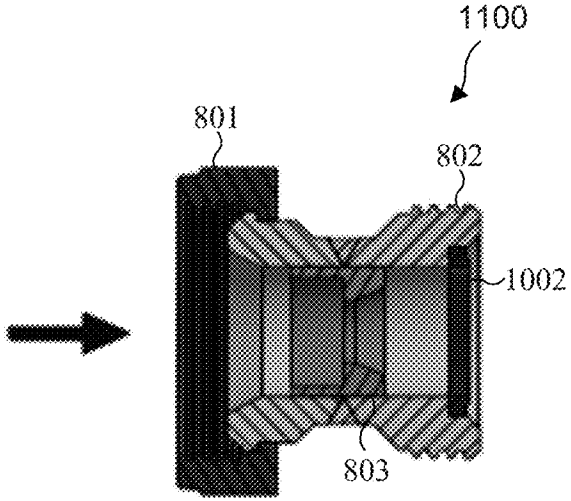
Figure 11:
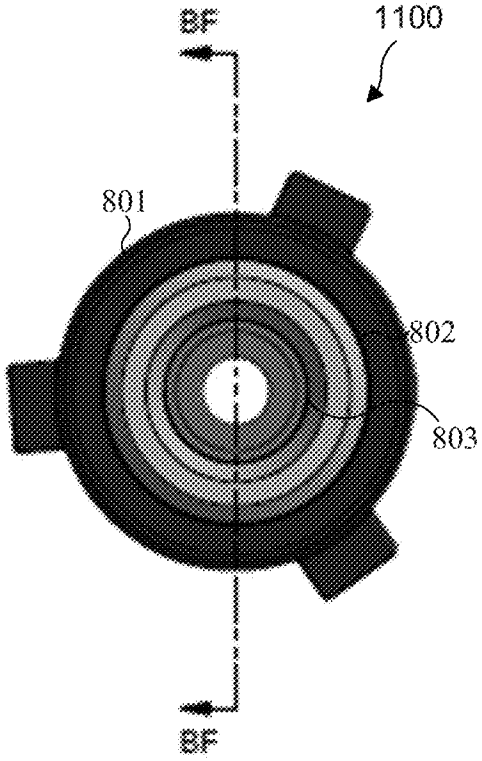

FIGS. 11, 11A and 11B illustrate the structure of a pulsation and acoustic energy reduction dampeners 1100 with a non-reversible orifice flow restriction except by acquiring the suitable pulsation and acoustic energy reduction dampener orifice with downstream tail assembly having a permanent tungsten carbide coated wear internal anulus in accordance with embodiments of the present disclosure. FIG. 11 is an end view, FIG. 11A is a side sectional view and, similarly, FIG. 11B is also a side sectional view. FIGS. 11, 11A and 11B are merely exemplary, for purposes of explaining the principles of the present disclosure and are not intended to be limiting. Pulsation and acoustic energy reduction dampeners 1100 may be mounted in the same manner as pulsation and acoustic energy reduction dampener 200 in FIG. 2, and provides similar benefits to those described above.

Depending upon the direction of pumped fluid flow, the flow restriction structure may be available within the pulsation and acoustic energy reduction dampener 1100 in either of two opposite orientations, as evident by comparing FIGS. 11A and 11B. It is also understood that this permanent welded in place orifice with downstream tail does not utilize a snap ring or annulus sleeve. The taper within the orifice plate 803 narrows in the direction of pumped fluid flow, narrowing toward the connection between male sub 806 with nut 801 and female sub 802 in the embodiment of FIG. 11A but narrowing away from that connection in the embodiment of FIG. 11B. Flow direction in this instance can also be reversed.

Pulsation and acoustic energy reduction dampener 1100 includes a winged annular male sub with nut 801 and an annular female sub 802 ((e.g., both 4" Fig 1002 Schedule XXH), which may be welded together. One end of the female sub 802 is received by the male sub with nut 801, with the other end of the male sub 806 including external threads configured to be received by a female connector.

Flow restriction in pulsation and acoustic energy reduction dampener is provided by a permanent non-reversible orifice with downstream tail assembly 803. The orifice with tail assembly structure includes the orifice feature and does not require a retainer sleeve or retaining snap ring. The orifice with downstream tail feature 803 is cylindrical with an axial through-hole that has a tapered portion, wider at one end of the orifice feature 803, leading into a cylindrical opening at the other end of the orifice feature 803. This permanent non-replaceable pulsation and acoustic energy reduction dampener is a rigid design and once worn in the field (after more than 5 drill hole cycles) will need to be replaced in its entirety.

Depending upon the direction of pumped fluid flow, the orientation of the internal flow restriction/orifice with downstream tail assembly will need to be determined by the contractor in advance, selecting the proper pulsation and acoustic energy reduction dampener for their application.

Figure 12A:
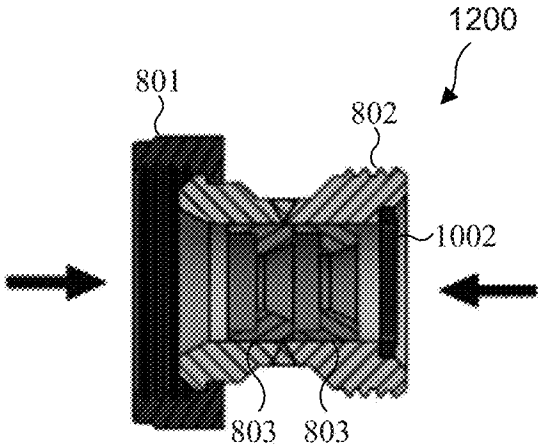
FIGS. 12, 12A, and 12B illustrate the structure of a bi-directional pulsation and acoustic energy reduction dampener with a non-replaceable multiple orifice flow restriction assembly shown here having a permanent tungsten carbide coated wear internal anulus in accordance with embodiments of the present disclosure.
Figure 12B:
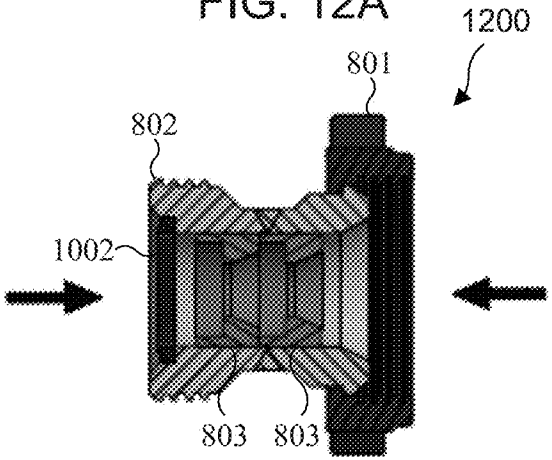
Figure 12:
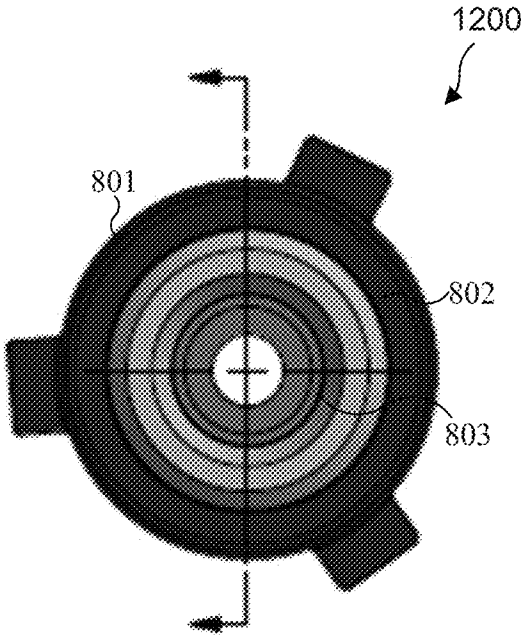

FIGS. 12, 12A, and 12B illustrate the structure of a bi-directional pulsation and acoustic energy reduction dampener 1200 with a non-replaceable multiple orifice flow restriction assembly shown here having a permanent tungsten carbide coated wear internal anulus in accordance with embodiments of the present disclosure. FIG. 12 is an end view, FIG. 12A is a side sectional view and, similarly, FIG. 12B is also a side sectional view. FIGS. 12, 12A, and 12B are merely exemplary, for purposes of explaining the principles of the present disclosure and are not intended to be limiting. The bi-directional pulsation and acoustic energy reduction dampener 1200 may be mounted in the same manner as pulsation and acoustic energy reduction dampener 200 in FIG. 2, and provides similar benefits to those described above.

Pulsation and acoustic energy reduction dampener 1200 includes a winged annular male sub with nut 801 and an annular female sub 802 ((e.g., both 4" Fig 1002 Schedule XXH), which may be welded together. One end of the female sub 802 is received by the male sub with nut 801, with the other end of the male sub 806 including external threads configured to be received by a female connector.

Flow restriction in the bi-directional pulsation and acoustic energy reduction dampener 1200 is provided by a permanent multiple orifice assembly 803. The multiple orifice assembly structure includes the orifice feature and does not require a retainer sleeve or retaining snap ring. The multiple orifice feature 803 is cylindrical with an axial through-hole that has a various tapered portions (two shown), wider at one end of the orifice feature 803, leading into a cylindrical opening at the other end of the orifice feature 803. This permanent non-replaceable pulsation and acoustic energy reduction dampener is a rigid design and once worn in the field (after more than 5 drill hole cycles) will need to be replaced in its entirety.

Depending upon the direction of pumped fluid flow, the orientation of the internal flow restriction/multiple orifice will need to be determined by the contractor in advance, selecting the proper pulsation and acoustic energy reduction dampener for their application.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A pulsation and acoustic energy reduction dampener to allow for easier signal detection by one of measurement while drilling (MWD) devices or logging while drilling (LWD) devices, the pulsation and acoustic energy reduction dampener comprising:

a body formed from a union connection sub and a union connection nut, the union connection sub having a threaded male connection at an opposite end from a coupling to the union connection nut and the union connection nut having a threaded female connection at an opposite end from a coupling to the union connection sub, each of the threaded connections for connection to piping; and a flow restriction orifice assembly with an internal orifice secured within the union connection sub and having a wear component, wherein the flow restriction orifice assembly comprises:

an annular collar secured within the union connection sub, and an annular wear insert having a first portion inserted into the annular collar and a second portion abutting a shoulder of the annular collar, wherein the second portion is not inserted into the annular collar.

2. The pulsation and acoustic energy reduction dampener according to claim 1, wherein at least the first portion of the annular wear insert has a cylindrical inner diameter along an axial length.

3. The pulsation and acoustic energy reduction dampener according to claim 1, wherein at least the first portion of the annular wear insert has a tapered inner diameter along an axial length.

4. The pulsation and acoustic energy reduction dampener according to claim 3, wherein at least the second portion of the annular wear insert has a cylindrical inner diameter along an axial length.

5. The pulsation and acoustic energy reduction dampener according to claim 1, wherein the annular wear insert is inserted into the union connection sub from a side of the coupling between the union connection sub and the union connection nut.

6. The pulsation and acoustic energy reduction dampener according to claim 1, wherein the annular wear insert is inserted into the union connection sub from a side of the threaded male connection.

7. The pulsation and acoustic energy reduction dampener according to claim 1, wherein the annular wear insert is one of ceramic, tungsten carbide or similar abrasion resistant materials.

8. A drilling or production system, comprising:

a standpipe positioned between drilling or production components and upstream components; and a pulsation and acoustic energy reduction dampener positioned downstream of the standpipe, the pulsation and acoustic energy reduction dampener comprising:

a body formed from a union connection sub and a union connection nut, the union connection sub having a threaded male connection at an opposite end from a coupling to the union connection nut and the union connection nut having a threaded female connection at an opposite end from a coupling to the union connection sub, each of the threaded connections for connection to piping, and a flow restriction orifice assembly with an internal orifice secured within the union connection sub and having a wear component, wherein the flow restriction orifice assembly comprises:

an annular collar secured within the union connection sub, and an annular wear insert having a first portion inserted into the annular collar and a second portion abutting a shoulder of the annular collar, wherein the second portion is not inserted into the annular collar.

9. The drilling or production system according to claim 8, wherein at least the first portion of the annular wear insert has a cylindrical inner diameter along an axial length.

10. The drilling or production system according to claim 8, wherein at least the first portion of the annular wear insert has a tapered inner diameter along an axial length.

11. The drilling or production system according to claim 10, wherein at least the second portion of the annular wear insert has a cylindrical inner diameter along an axial length.

12. The drilling or production system according to claim 8, wherein the annular wear insert is inserted into the union connection sub from a side of the coupling between the union connection sub and the union connection nut.

13. The drilling or production system according to claim 8, wherein the annular wear insert is inserted into the union connection sub from a side of the threaded male connection.

* * * * *